US005174369A

United States Patent [19]

Glass

[11] Patent Number: 5,174,369

[45] Date of Patent: Dec. 29, 1992

[54] SANITARY CONCENTRIC TUBE HEAT EXCHANGER

[75] Inventor: Gerald E. Glass, Springfield, Mo.

[73] Assignee: Custom Metalcraft Inc., Springfield, Mo.

[21] Appl. No.: 756,974

[22] Filed: Sep. 9, 1991

[51] Int. Cl.[5] ..... F28D 7/10

[52] U.S. Cl. ..... 165/155; 165/154; 165/82; 165/144

[58] Field of Search ..... 165/81-83, 165/154, 155

[56] References Cited

U.S. PATENT DOCUMENTS

| | | | |
|---|---|---|---|
| 938,779 | 11/1909 | Morrison | 165/155 X |
| 2,372,079 | 3/1945 | Gunter | 165/141 |
| 2,445,115 | 7/1948 | Hanrahan | 165/141 |
| 2,698,162 | 12/1954 | Riesgo | 165/154 |
| 2,706,620 | 4/1955 | Graves | 165/141 |
| 2,712,438 | 7/1955 | Brown, Jr. | 165/154 |
| 3,651,551 | 3/1972 | Cannon | 165/141 X |
| 3,722,582 | 3/1973 | Rinecker | 165/143 |
| 4,059,882 | 11/1977 | Wunder | 165/154 X |
| 4,296,612 | 10/1981 | Allo | 62/123 |
| 4,612,980 | 9/1986 | Roberts | 165/158 |
| 4,679,622 | 7/1987 | Cannon | 165/154 |
| 4,834,172 | 5/1989 | Duran | 165/143 |

FOREIGN PATENT DOCUMENTS

| | | | |
|---|---|---|---|
| 900 | 7/1877 | Fed. Rep. of Germany | 165/155 |
| 58-129196 | 8/1983 | Japan | 165/83 |

*Primary Examiner*—Allen J. Flanigan
*Attorney, Agent, or Firm*—Nies, Kurz, Bergert & Tamburro

[57] ABSTRACT

A sanitary concentric tube heat exchanger for cooling or heating flowable or pumpable products is disclosed. In one embodiment, two concentric tubes are sealed together with inlet and outlet openings. The product is allowed to flow through the outer of the two tubes while the heating or cooling medium flows through the inner tube. In another embodiment, a third concentric tube surrounds the product tube and is used for the flow of additional heating or cooling medium. A securing clamp open on one end of the product tube secures the product tube to the outer surface of the inner tube and can be easily dismantled for cleaning purposes. A seal assembly secures the other end of the product tube to the outer surface of the inner tube and permits relative movement between the inner tube and the product tube for accommodation of thermal effects during operation, and also to allow the asembly to be easily dismantled for cleaning or inspection.

8 Claims, 2 Drawing Sheets

10
12
14
16
18
20
22
24
26
28
30
32
34
38
40
50
52
54
56
60
62
64
MEDIUM
MEDIUM
MEDIUM
PRODUCT
PRODUCT

SANITARY CONCENTRIC TUBE HEAT EXCHANGER

BACKGROUND AND SUMMARY OF THE INVENTION

The present invention relates to apparatus for the sanitary cooling or heating of flowable or pumpable products. More particularly, the present invention relates to a heat exchanger for receiving a flow of product to be heated or cooled into a tube and for receiving a heating or cooling medium into a separate tube concentric to the product tube allowing for a sanitary processing of the product.

Previous heat exchangers are described, for example, in the following U.S. patents: U.S. Pat. No. 2,372,079 to Gunter; U.S. Pat. No. 2,445,115 to Hanrahan; U.S. Pat. No. 2,706,620 to Graves; U.S. Pat. No. 3,651,551 to Cannon; U.S. Pat. No. 3,722,582 to Rinecker; U.S. Pat. No. 4,296,612 to Allo; U.S. Pat. No. 4,612,980 to Roberts; U.S. Pat. No. 4,679,622 to Cannon; and U.S. Pat. No. 4,834,172 to Duran.

By the present invention, there is provided a heat exchanger which allows the cooling and heating of a flowable or pumpable product by the use of concentric tubes. In one embodiment, the product enters one tube and is heated or cooled by a medium flowing through a separate concentric tube attached to the product tube by sealing mechanisms on both ends. In a further embodiment, a third tube is employed so as to allow heating or cooling on both the interior and exterior of the product tube.

Accordingly, it is one object of the present invention to provide a heat exchanger which is symmetrical in shape so as to permit simple connection for utilizing a plurality of heat exchangers in series.

It is another object of the present invention to provide a heat exchanger which can be easily dismantled without the use of tools to allow for inspection and cleaning of product contact areas.

It is yet another object of the present invention to provide a sanitary heat exchanger which will not contaminate the product with the heating or cooling medium in the event a sealing mechanism should fail.

It is another object of the present invention to provide an angled product inlet and outlet in order to flush the area with either the product during normal operation or cleaning solution during a clean-in-place cycle.

It is still another object of the present invention to permit relative movement between adjacent tubes to accommodate thermal effects which may occur during operation.

These and other objects and features of the present invention will be apparent from the following description in which the preferred embodiment is set forth in detail in conjunction with the accompanying drawings.

DESCRIPTION OF THE PREFERRED EMBODIMENTS

Figure 1:
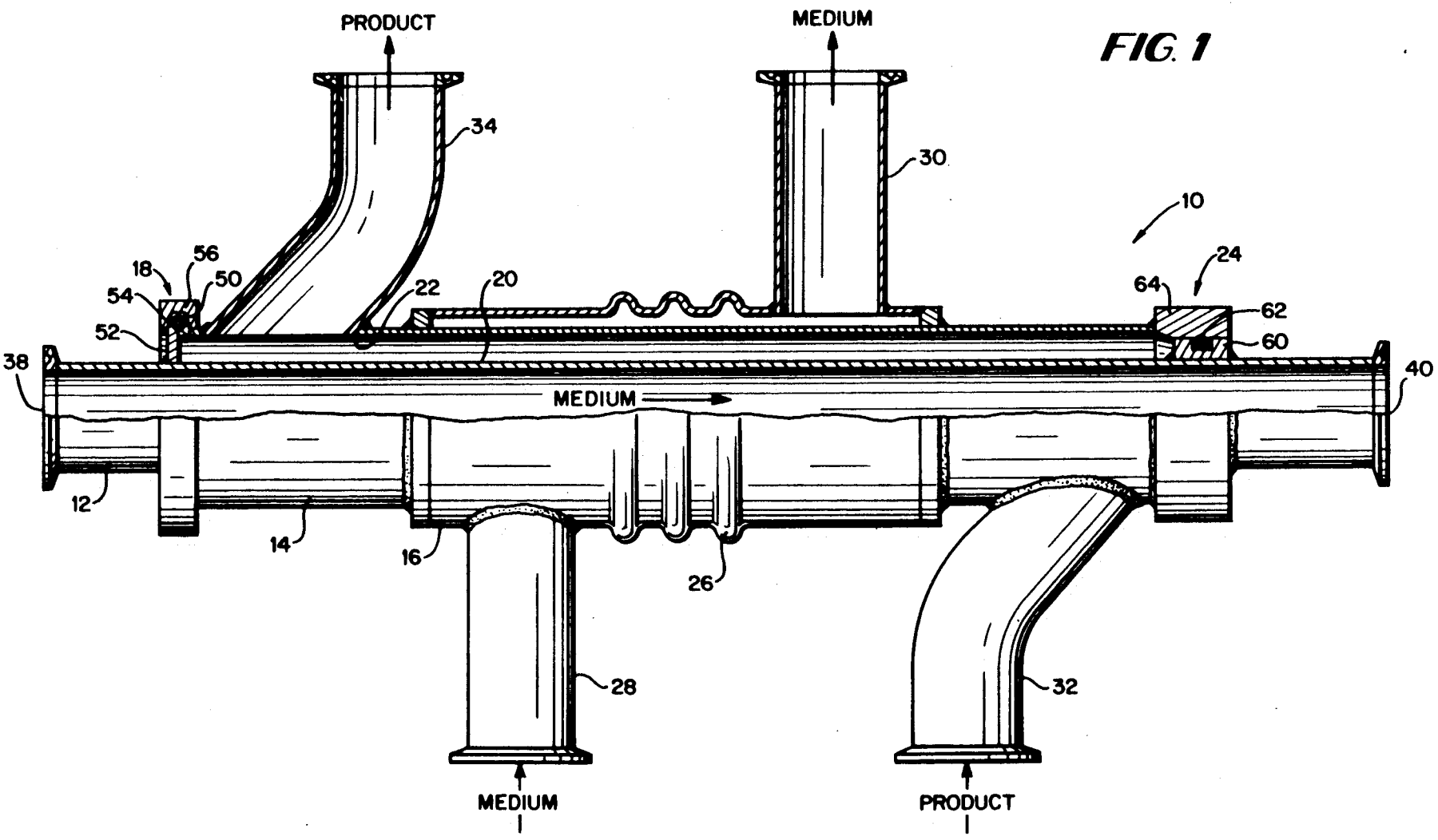
FIG. 1 is a side view in partial cross section of the concentric sanitary tube heat exchanger of the present invention.

In the embodiment of the present invention as shown in FIG. 1, there is provided a sanitary concentric tube heat exchanger 10, symmetrical in shape for simple connection in series, with three concentric tubes 12, 14 and 16. The inner tube 12 is enclosed respectively by the intermediate product tube 14 and the outer tube 16 and protrudes beyond the length of both tubes 14, 16 on both sides of the heat exchanger 10. The inner tube 12 is connected to the product tube 14 on one end by a securing clamp 18 which can be easily dismantled without tools for inspection and/or cleaning of product contact areas 20, 22. The product contact areas 20, 22 are the outer surface of the inner tube 12 and the inner surface of the product tube 14 respectively which together form the boundary for the product which is input into the heat exchanger 10.

The securing clamp 18 includes metal ring members 50, 52 having an O-ring 54 inserted between the ring members 50, 52. Ring member 50 is secured by welding to the product tube 14 while ring member 52 is secured to the inner tube 12. An outer metal clamp member 56 such as a two piece unit mounted with bolts is secured around the rings 50, 52.

The inner tube 12 is connected to the product tube 14 on the end opposite the securing clamp 18 by a seal assembly 24 which permits relative movement between the inner tube 12 and the product tube 14 to accommodate thermal effects occurring in the operation of the heat exchanger 10. The outer tube 16 contains corrugated "bellows" 26 to accommodate thermal effects between the outer tube 16 and the product tube 14. The corrugated bellows portion 26 of the tube 16 may be of thinner material to facilitate expansion and contraction.

The seal assembly 24 includes inner metal ring member 60 secured by welding to the inner tube 12 and with O-ring 62 positioned in a cavity in the ring 60 as shown in FIG. 1. An outer metal ring member 64 is fitted closely adjacent the ring 60 and secured to the product tube 14 so as to sealingly engage the O-ring 62.

The outer tube 16 has a medium inlet 28 and a medium outlet 30 perpendicular to the longitudinal axis and on opposite sides of the outer tube 16, which operate to allow flow of heating or cooling medium through the outer tube 16. The length of the outer tube 16 is shorter than the length of the intermediate tube 14 so as to permit no contamination of the product by the heating or cooling medium in case of failure of the seal assembly 24.

The product tube 14 has a product inlet 32 and a product outlet 34 which are angled toward the seal assembly 24 and the securing clamp 18, respectively, on opposite sides of the product tube 14 such that the product inlet 32 and the medium inlet 28 are located adjacent each other on one side of the heat exchanger 10, and the product outlet 34 and the medium outlet 30 are located adjacent each other on the opposite side of the heat exchanger 10. The product inlet 32 and product outlet 34 are angled so as to flush the area inside the intermediate tube 14 with either the product during normal operation of the heat exchanger 10, or with cleaning solution during a clean in place cycle. This angle may be about 45 to 60 degrees with respect to the longitudinal axis of the intermediate tube 14.

The inner tube 12 has a medium inlet 38 at one end and a medium outlet 40 at the other end which permit flow of heating or cooling medium through the inner tube 12.

It is within the scope of the invention to employ a two-tube heat exchanger, using tubes 12 and 14, or to add the third tube 16 for a three-tube heat exchanger.

Figure 2:
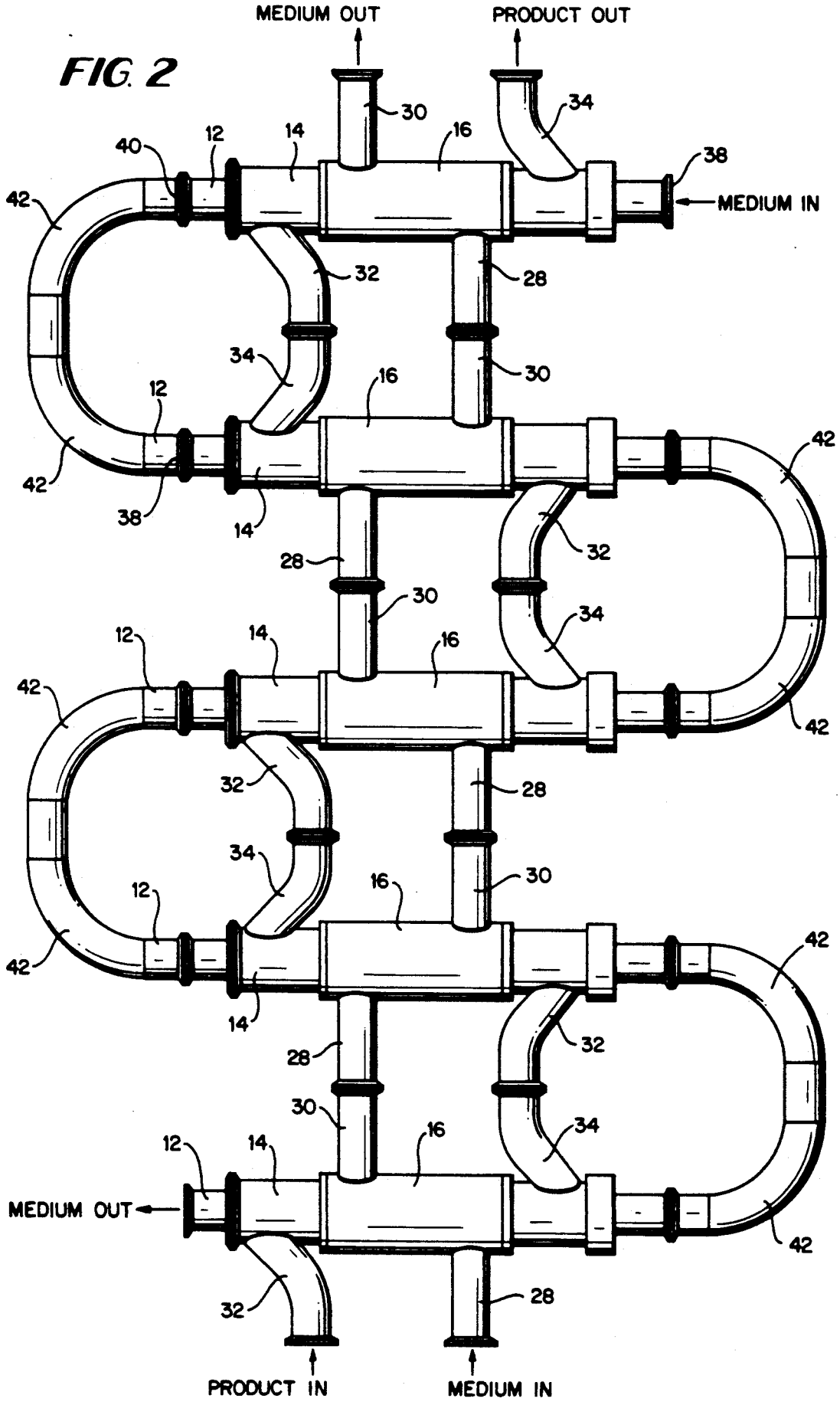
FIG. 2 is a side view of a plurality of the heat exchangers of FIG. 1 arranged in series.

In the embodiment of the present invention as shown in FIG. 2, there is provided a plurality of heat exchangers connected in series by a connecting tube 42 which connects the medium outlet 40 of one heat exchanger to the medium inlet 38 of the next heat exchanger. The product tubes 14 and outer tubes 16 are similarly connected through the respective inlets 28, 32 and outlets 30, 34, with the heat exchanger assemblies being inverted as necessary in order to obtain the series configuration as shown in FIG. 2.

In the operation of the heat exchanger 10 as shown in FIG. 1, a product to be heated or cooled is allowed to flow into the product tube 14 through the product inlet 32 and out through the product outlet 34. A heating or cooling medium is allowed to flow into the medium inlet 38 of the inner tube 12 and a second heating or cooling medium passes into the medium inlet 28 of the outer tube 16. The product liquid is retained within the intermediate tube 14 by the securing clamp 18 and the seal assembly 24 which seal opposite ends of the product tube 14 in conjunction with the outer surface 20 of the inner tube 12. While the product is within the intermediate tube 14, the medium within the inner tube 12 and the medium within the outer tube 16 act to either cool or heat the product as desired by a continual flow of medium through the medium inlets 28, 38 and out the medium outlets 30, 40.

The seal assembly 24 is constructed so as to accommodate the thermal effects which may occur during the flow of the product and medium through the product tube 14 and inner tube 12, respectively. Corrugated "bellows" 26 on the outer tube 16 also act to accommodate the thermal effects which may occur between the outer tube 16 and the product tube 14 during operation. In the event the seal assembly 24 fails, no contamination of the product can occur since the product would simply escape into the surrounding atmosphere.

To dismantle the assembly 10, the clamp 18 is removed and the inner tube 12 is pulled out through the clamp end. This exposes product contact surface areas 20, 22 for cleaning.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A sanitary concentric tube heat exchanger for heating or cooling flowable or pumpable products, comprising:

a first tube for receiving a heating or cooling medium, said first tube having first and second ends which provide a medium inlet and a medium outlet;

a second tube disposed about and concentric with said first tube for receiving a flowable or pumpable product, said second tube having first and second ends which provide a product inlet and a product outlet;

a securing clamp located at the first end of said second tube for securing said first end of said second tube to said first tube;

a seal assembly located at the second end of said second tube for sealing said second end of said second tube to said first tube;

a third tube disposed about and concentric with said second tube, said third tube having first and second ends which provide a medium inlet and a medium outlet, and with the medium inlet and medium outlet of said third tube being in tubular form and extending perpendicular to the longitudinal axis of said third tube;

wherein the product outlet of the second tube is in tubular form and having an angled portion which extends toward said clamp at the first end of said second tube and the product inlet of the second tube is in tubular form and having an angled portion which extends toward said seal assembly at the second end of said second tube, with each of said product inlet and product outlet having a portion extending radially outwardly of said angled portions which is perpendicular to the longitudinal axis of said second tube; and wherein the medium inlet of said third tube and the product inlet of said second tube are located on the same side of the longitudinal axis of said heat exchanger and with the medium outlet of said third tube and the product outlet of said second tube being located on the opposite side of the longitudinal axis of said heat exchanger, thus providing a symmetrical shape to facilitate interconnection of a plurality of said heat exchangers in series.

2. The heat exchanger of claim 1 wherein said securing clamp includes a pair of ring members having an O-ring inserted therebetween and with an outer clamp member which is removable without tools for inspection or cleaning of an outer surface of said first tube and an inner surface of said second tube.

3. The heat exchanger of claim 1 wherein said seal assembly permits relative movement between said first tube and said second tube to accommodate thermal effects which may occur between said first tube and said second tube.

4. The heat exchanger of claim 1 wherein said seal assembly includes an inner ring member secured to said first tube, said inner ring having a cavity in the outer surface in which an O-ring is installed, and with an outer ring member secured to the second tube and sealingly engaging said O-ring.

5. The heat exchanger of claim 1 wherein said third tube is provided with corrugated bellows which extend circumferentially around said third tube for accommodation of thermal effects which may occur between said second tube and said third tube.

6. The heat exchanger of claim 1 wherein the angle of the product inlet tube and product outlet tube relative to the longitudinal axis of the second tube is about 45 to 60 degrees.

7. The heat exchanger of claim 1 wherein a plurality of said heat exchangers are interconnected to provide a heat exchange system.

8. The heat exchanger of claim 1 wherein said third tube is of shorter length than said second tube to avoid contamination of product with medium in the event said seal assembly fails.

* * * * *